US009433977B2

(12) United States Patent
Zhu

(10) Patent No.: US 9,433,977 B2
(45) Date of Patent: Sep. 6, 2016

(54) SINGLE-SHAFT TRACK-CHANGEABLE VIBRATION EXCITER

(75) Inventor: Xingliang Zhu, Yiwu (CN)

(73) Assignee: ZHEJIANG BLACK-AND-WHITE MINING MACHINERY CO., LTD, Yiwu, Zhejiang (CN)

( * ) Notice: Subject to any disclaimer, the term of this patent is extended or adjusted under 35 U.S.C. 154(b) by 199 days.

(21) Appl. No.: 14/129,963

(22) PCT Filed: Jun. 27, 2012

(86) PCT No.: PCT/CN2012/077574

§ 371 (c)(1),
(2), (4) Date: Dec. 28, 2013

(87) PCT Pub. No.: WO2013/000402

PCT Pub. Date: Jan. 3, 2013

(65) Prior Publication Data

US 2014/0216182 A1 Aug. 7, 2014

(30) Foreign Application Priority Data

| | | |
|---|---|---|
| Jun. 28, 2011 | (CN) | 2011 2 02259154 U |
| Jan. 4, 2012 | (CN) | 2012 1 00098161 |
| Jan. 4, 2012 | (CN) | 2012 1 00119524 |
| Jan. 4, 2012 | (CN) | 2012 1 00119736 |

(51) Int. Cl.
*B07B 1/42* (2006.01)
*B07B 1/28* (2006.01)

(52) U.S. Cl.
CPC ..... *B07B 1/42* (2013.01); *B07B 1/284* (2013.01); *Y10T 74/18064* (2015.01)

(58) Field of Classification Search
USPC ..... 209/326, 365.2, 366, 395
See application file for complete search history.

(56) References Cited

U.S. PATENT DOCUMENTS

| | | | | |
|---|---|---|---|---|
| 1,769,413 A * | 7/1930 | Binte | B07B 1/40 | 209/344 |
| 2,118,782 A * | 5/1938 | Symons | B07B 1/286 | 209/403 |
| 2,176,376 A * | 10/1939 | Denovan | B07B 1/286 | 209/326 |
| 2,208,127 A * | 7/1940 | Hallenbeck | B07B 1/286 | 209/329 |
| 2,819,796 A * | 1/1958 | Edwards | B07B 1/46 | 209/319 |
| 5,494,173 A * | 2/1996 | Deister | B07B 1/42 | 209/326 |

FOREIGN PATENT DOCUMENTS

| | | | |
|---|---|---|---|
| GB | 190907977 A * | 0/1910 | B07B 1/286 |

* cited by examiner

*Primary Examiner* — Terence Boes
*Assistant Examiner* — Randell J Krug

(57) ABSTRACT

A single-shaft track-changeable vibration exciter comprises a vibration box (1), a bottom seat (2), a vibrating spring (19), and a vibrating shaft (3). The vibrating shaft (3) is set on the vibration box (1). The vibrating spring (19) is set between the vibration box (1) and the bottom seat (2). Multiple groups of track-restricting rod assemblies that are arranged aslant are set in two sides of the vibration box (1), and each group of the track-restricting rod assembly comprises two track-restricting rod assemblies that are arranged symmetrically in the both sides of the vibration box (1). Both ends of the each track-restricting rod assembly are hinged respectively on the vibration box (1) and the bottom seat (2).

2 Claims, 16 Drawing Sheets

SINGLE-SHAFT TRACK-CHANGEABLE VIBRATION EXCITER

CROSS REFERENCE OF RELATED APPLICATION

This is a U.S. National Stage under 35 U.S.C 371 of the International Application PCT/CN2012/077574, filed Jun. 27, 2012, which claims priority under 35 U.S.C. 119(a-d) to CN 2011202259154, filed Jun. 28, 2011, CN 2012100119524, filed Jan. 4, 2012, CN 2012100119736, filed Jan. 4, 2012, CN 2012100098161, filed Jan. 4, 2012, CN 2012100098316, filed Jan. 4, 2012.

BACKGROUND OF THE PRESENT INVENTION

1. Field of Invention

The present invention relates to the field of mechanical vibration technology, and more particularly to the mining machine for the vibration exciter assembly of two devices of the vibrating screen or the feeding machine, and more specifically to a single-shaft track-changeable vibration exciter.

2. Description of Related Arts

Up to now, the mechanical vibration exciter of the conventional technology can be divided into three categories of circular motion, linear motion, and elliptical motion based on the motion track. The mechanical vibration exciter of the conventional technology can be divided into three kinds of single-shaft, double-shaft, and triple-shaft based on the structure of the vibration exciter. Various structures of vibration exciters achieve motion tracks that are described as followed.

1. The circular motion track is realized by the vibration exciter.

2. The linear motion track is realized by the double-shaft vibration exciter.

3. The elliptical motion track is realized by the triple-shaft vibration exciter.

Several improvements and innovations have been made, and several patents and utility model patents are also disclosed. For example, the patent number is CN200920213889.6, and the title is "Single-shaft circular vibrating motion track vibration exciter for mechanical vibrating screen"; the patent number is CN200310119021.7, and the title is "Double-shaft inertial vibration exciter"; the patent number is CN200920213200.X, and the title is "Triple-shaft vibrator of elliptical vibrating screen". Although they have their advancements, they do not go beyond the thinking framework of the combination of single-shaft or multi-shaft.

When the motion track is different, the working effect of vibration exciter produced is also different. Specifically working effects of vibration exciters are described as followed.

1. The single-shaft vibration exciter produces the circular motion track. Advantages of the single-shaft vibration exciter comprise the single-shaft vibration exciter not only has the vibrating component force in normal direction but also has the vibrating component force in tangential direction, and critical materials are not easy to plug holes on the screen mesh. Disadvantages of the single-shaft vibration exciter comprise when single-shaft vibration exciter is combined with the motion of the spring that is in the vibration box, materials only can move in up and down sieving, but cannot move in horizontal conveying, because the horizontal component force is extremely slight. Therefore, all devices with single-shaft vibration exciters on sale are all put aslant, for using gravity to produce the horizontal conveying motion. Because of putting aslant, materials drop down in a hurry and are not fully sieved. Thus, the sieving effect is not good.

2. The double-shaft vibration exciter produces the linear motion track. Advantages of the double-shaft vibration exciter comprise the vibrating direction angle which can be adjusted between 0° to 90° through changing eccentric phase angles of two vibrating shafts, usually direction angles between 30° to 60° are selected to use. Accordingly, materials can be moved in up and down vertical sieving and also can be moved in horizontal conveying, so the double-single vibration exciter can be put horizontally to use. Because of putting horizontally, materials are sieved fully, and the sieving effect is excellent. Disadvantages of the double-shaft vibration exciter comprise that because of the linear motion, the double-shaft vibration exciter only can be vibrate in normal direction but cannot be vibrated in tangential direction, so critical materials are easy to plug holes on the screen mesh, and the sieving effect is reduced.

3. The triple-shaft vibration exciter produces the elliptical motion track. Advantages of the triple-shaft vibration exciter synthesize advantages of the circular motion and the linear motion. The triple-shaft vibration exciter can be put horizontally to use, and critical materials are not easy to plug holes on the screen mesh. However, disadvantages of the triple-shaft vibration comprise that the structure is complicated, the manufacturing cost is high, and the power consumption is large. When the triple-shaft vibration exciter as well as the double-shaft vibration exciter, are adjusted to the direction angle, the vibration exciter should be opened to dismantle the gear, i.e., adjusting the eccentric phase angle difference of the vibrating shaft, which is not easy. Users are easy to make mistakes when they adjust the eccentric phase angle difference of the vibrating shaft.

To sum up, if using the single-shaft vibration exciter in the conventional technology, the structure is simple but the single-shaft vibration exciter has to be put aslant, so the sieving effect is decreased largely, and the height difference between the higher end and the lower end that is set by the vibration box is large, which occupies a larger space, and increases the installation cost. If using the multi-shaft vibration exciter in the conventional technology, the multi-shaft vibration exciter can be put horizontally and the working effect of the multi-shaft vibration exciter is improved, but the consumable of the mechanism is large, the difficulty of manufacturing is big, the running cost is high, and the vibrating direction angle is not easy to be adjusted.

The biggest disadvantage of the conventional technology is that a vibration exciter only can realize a motion track, and different motion tracks cannot be switched in a device.

SUMMARY OF THE PRESENT INVENTION

An object of the present invention is to provide a single-shaft track-changeable vibration exciter which has a simple structure, and a low cost. The single-shaft track-changeable vibration exciter can form several kinds of motion tracks. The single-shaft track-changeable vibration exciter is adapted to various working conditions requirements. The single-shaft track-changeable vibration exciter can be adjusted easily, an exciting efficiency is high, and an effect of a sieving is excellent. Technical problems existing in a conventional technology, that different motion track is needed to select different vibration exciter, the structure is complicated, and they are not easy to adjust, are solved.

Technical problems mentioned above are solved by technical schemes in the present invention, which are described as followed.

A single-shaft track-changeable vibration exciter comprises:

a vibration box, a bottom seat, a vibrating spring, a vibrating shaft;

wherein the vibrating shaft is set on the vibration box, and the vibrating spring is set between the vibration box and the bottom seat. Multiple groups of track-restricting rod assemblies that are arranged aslant are set in two sides of the vibration box. Each group of the track-restricting rod assembly comprises two track-restricting rod assemblies that are arranged symmetrically in both sides of the vibration box, and both ends of each track-restricting rod assembly are hinged on the vibration box and the bottom seat.

The track-restricting rod assembly is a core component of a structure of the present invention. The track-restricting rod assembly determines a motion track of an exciting force, wherein a track-restricting rod is a rod that determines the movement track.

Structural characteristics of the present invention are described as followed.

(1) A single shaft to be an exciting source is used.

(2) A track-restricting rod mechanism that is arranged aslant and symmetrically is further set.

(3) A vibration box is not needed to put aslant, and can be installed horizontally to use.

(4) An adjusting mechanism of the vibration-exciting direction angle is installed externally.

Functional characteristics of the present invention are described as followed.

(1) A vibration box can be put horizontally to install and to use under a structure of a single-shaft vibration exciter, i.e., a circular motion track has a vibrating direction angle.

(2) Three exciting motion tracks of a circular motion track, a linear motion track, and an elliptical motion track can be switched in a same device.

(3) The vibrating direction angle can be adjusted externally, visually, and simply.

A core technology of the present invention is described as followed.

A structural design of combining a single-shaft vibration exciter and a track-restricting rod assembly is used. A function of three motion tracks of circular, linear, and elliptical can be realized in one device, and three motion tracks can be switched easily. The structural design replaces a conventional technology that needs to respectively use a single-shaft, a double-shaft, and a triple-shaft to realize functions mentioned above. Thus, a function and an efficiency of a vibration exciter are increased largely.

The present invention has a function of an exciting force of three motion tracks of circular, linear, and elliptical, and the function of the exciting force can be switched easily in one device. Principles of a mechanization are described as followed.

A track-restricting rod assembly moves in two dividing motions under a circular inertial force of an eccentric shaft, which are described as followed.

(1) Along with an axial direction of a track-restricting rod, the track-restricting rod assembly moves for a short distance of a slip and linear motion. The motion track is a straight line. A moving length is determined by a slip spacing that is set in the track-restricting rod.

(2) The track-restricting rod assembly moves for the short distance of a rocking and arc motion based on that a circle center is an upper fulcrum of the track-restricting rod and a radius is a length from a lower fulcrum to the upper fulcrum, and the motion track is an arc line. Because the arc line is very short, the arc line can be approximated to be a straight line. A length of the arc line is determined by a spring characteristic, i.e., an elasticity.

The combination of the slip and linear motion, and the rocking and arc motion, are represented to be motion tracks of circular, linear, and elliptical, for producing exciting forces of multiple and different motion tracks.

A long axis of the ellipse of the motion track is determined by a weight of a vibration box and the spring characteristic, i.e., a elastic spacing, which is a fixed value. A short axis of the ellipse of the motion track is determined by adjusting the slip spacing of the track-restricting rod, wherein the slip spacing can be adjusted, and usually can be adjusted between 0 mm to 20 mm. The range of adjusting the slip spacing is specifically described as followed.

1. When the slip spacing is 0 mm, the motion track is shown as a straight line, but the motion track is an arc line actually.

2. When the slip spacing equals to an arc length, the motion track is shown as a circle;

3. When the slip spacing does not equal to the arc length, the motion track is shown as an ellipse.

Significant effects of the present invention are described as followed.

1. Through adjusting a slip spacing of a track-restricting rod, different motion tracks of circular, linear, and elliptical can be switched, which can be realized easily in one device. The function is similar to functions that a single-shaft vibration exciter, a double-shaft vibration exciter, and a triple-shaft vibration exciter independently produce the circular motion track, the linear motion track, and the elliptical motion track.

2. If changing a slant range of a track-restricting rod, a vibrating direction angle can be adjusted easily.

3. Functions of the present invention mentioned above are realized under a condition of the single-shaft vibration exciter, which are described as followed.

The single-shaft vibration exciter of a conventional technology only can realize an exciting force of the circular motion track, and the exciting force of the circular motion track does not have a vibrating direction angle. Materials only can be moved in an up and down sieving but cannot be moved in a horizontal conveying. Therefore, the single-shaft vibration exciter of the conventional technology can be run only when a vibration box is put aslant to install and a gravity is used to produce motion in the horizontally conveying of materials.

The present invention has a vibrating direction angle by using a structural design of combining a single-shaft vibration exciter and a track-restricting rod under a condition of the single-shaft vibration exciter, no matter which motion track. A limitation that the single-shaft vibration exciter is used with the vibration box put aslant is changed. The single-shaft vibration exciter realizes installing and using the vibration box horizontally.

That is to say, with the same single-shaft vibration exciter, the single-shaft vibration exciter of the conventional technology can be used with the vibration box put aslant, but the single-shaft vibration exciter of the present invention can be used with the vibration box put horizontally, so that materials can be sieved more fully, and an effect of a sieving is more excellent.

Preferably, groups of the track-restricting rod assemblies are arranged symmetrically by a longitudinal line where a fixed axis of the vibrating shaft is located. When a group number of the track-restricting rod is an odd number, in the track-restricting rod assemblies which are in a same side of the vibration box, an upper end of an articulated position of the track-restricting rod assembly in a middle position is set on the longitudinal line where the fixed axis of the vibrating shaft is located. Other track-restricting rod assemblies are arranged symmetrically on the longitudinal line where the fixed axis of the vibrating shaft is located.

When observing in a side, in a group of the track-restricting rod assemblies whose group number is the odd number, the upper end of the articulated position that is in a middle group, and the longitudinal line where the fixed axis of the vibrating shaft is located, are in a same straight line. When only one group of the track-restricting rod assembly is provided, the track-restricting rod assembly and an articulated shaft are set on the longitudinal line where the fixed axis of the vibrating shaft is located. For a circular motion track of a single-shaft vibration exciter in a conventional technology keeps moving in balance before and after the vibrating box with the longitudinal line where a fixed axial lead of the vibrating shaft is located as a boundary, when a limited motion goes beyond the longitudinal line, an amplitude of the front of the vibration box and the back of the vibration box is not symmetrical, a vibration balance cannot be guaranteed. Thus, the track-restricting rod assembly is set as the structure mentioned above, so that the vibrating balance can be well guaranteed.

Alternatively, when a group number of a track-restricting rod assembly is an even number, the track-restricting rod assemblies which are in a same side of a vibration box is arranged symmetrically by a center of the longitudinal line where the fixed axis of the vibrating shaft is located.

Track-restricting mechanism are set in pairs, and are arranged symmetrically in both sides of the vibration box, specifically are arranged in two sides of the vibration box of two ends positions of the vibrating shaft, and the track-restricting rod mechanism that is in a same side of the vibration box are arranged symmetrically, in such a manner that a vibration balance is further increased.

Preferably, an angle is formed by a track-restricting rod assembly and a horizontal plane where a vibration box is located, which is an acute angle. A range of the acute angle is between 30° to 60°. A sum of the acute angle and a vibrating direction angle is 90°. $\beta$ is the vibrating direction angle, and $\alpha$ is the acute angle. A relationship between $\beta$ and $\alpha$ is that $\beta=90°-\alpha$.

An advantageous effect is caused, which is described as followed.

In the conventional technology, a linear motion track and an elliptical motion track have a vibrating direction angle, so a vibration box of a single-shaft vibration exciter is used by putting horizontally, but a circular motion track does not have the vibrating direction angle, so the vibration box should be put aslant, for producing a horizontal conveying force by gravity. However, in the present invention, no matter the linear motion track, the elliptical motion track, or the circular motion track, the single-shaft vibration exciter can be put horizontally to be used, and works in a most effective condition.

An angle of $\beta$ is determined by an angle of $\alpha$. Therefore, in order to adjust the angle of $\alpha$ of the track-restricting rod assembly easily, an arc regulator is set. Theoretically, the angle of $\alpha$ can be adjusted between 0° to 90°, usually the angle of $\alpha$ is excellent to adjust between 30° to 60°.

Structures of track-restricting rod assemblies have various forms. According to different motion tracks and different working conditions requirements, multiple structural forms can be designed, which are described as followed.

Preferably, a track-restricting rod assembly comprises an arc regulator and a track-restricting rod. The arc regulator is fixed on the bottom seat. Arc slotted holes are set on the arc regulator. A first end of the track-restricting rod is hinged in the arc slotted hole. A second end of the track-restricting rod is hinged on a vibration box. A length of the track-restricting rod cannot be adjusted, and a motion track formed is a linear motion track.

A motion track of a vibration exciter with the structure of the track-restricting rod assembly is a linear motion track. Advantages of the structure of the track-restricting rod assembly are described as followed.

The structure of the track-restricting rod assembly is simple for maintenance. The vibration exciter is especially suitable to a limited condition of the single linear motion track and a requirement of a low investment amount.

Alternatively, a track-restricting rod assembly comprises an arc regulator and a track-restricting rod. The arc regulator is fixed on the bottom seat. Arc slotted holes are set on the arc regulator. The track-restricting rod comprises an upper track-restricting rod and a lower track-restricting rod. Threads are set on external circumferential surfaces of the upper track-restricting rod and the lower track-restricting rod, and the thread of the upper track-restricting rod and the thread of the lower track-restricting rod are in an opposite direction. A threaded sleeve is set in a joint of the upper track-restricting rod and the lower track-restricting rod. A first end of the upper track-restricting rod is hinged on a vibration box. A second end of the upper track-restricting rod is received in the threaded sleeve. A first end of the lower track-restricting rod is hinged in the arc slotted hole, and a second end of the lower track-restricting rod is received in the threaded sleeve.

The track-restricting rod is fixed in the threaded sleeve, and the threaded sleeve moves in a little arc migration motion. The structure of the track-restricting rod assembly mentioned above limits a circular motion track of a single-shaft vibration exciter of a conventional technology, which changes the circular motion track into a linear motion track. Therefore, materials not only can move in an up and down vertical sieving, but also can move in a horizontal conveying, in such a manner that the materials can be sieved more fully, a sieving effect is more ideal, a limitation condition of the vibration box that is put aslant by the single-shaft vibration exciter is removed, and the vibration box can be put horizontally.

The track-restricting rod is coordinated with the threaded sleeve by the thread, so a length of the track-restricting rod can be adjusted. When installing the track-restricting rod assembly in a factory, any length requirements of the track-restricting rod can be satisfied within a size range of the track-restricting rod assembly easily.

A function of the structural scheme is same with the previous structural scheme, but a difference is that the length of the track-restricting rod can be adjusted. When an elasticity of compression of a spring is changed, the length of the track-restricting rod can be adjusted a little to make sure that the device works in a best condition.

Alternatively, a track-restricting rod assembly comprises an arc regulator and a track-restricting rod. The arc regulator is fixed on the bottom seat. Arc slotted holes are set on the arc regulator. The track-restricting rod comprises a polished rod. A sliding sleeve is sleeved on the polished rod. The sliding sleeve is hinged on a vibration box. The polished rod is hinged in the arc slotted holes.

A motion track of the vibration exciter with the structure of the track-restricting rod assembly is an elliptical motion track. Advantages of the vibration exciter with the structure of the track-restricting rod assembly are described as followed.

The structure of the track-restricting rod assembly is simple for maintenance. The vibration exciter is especially suitable to a limited condition of the elliptical motion track and a requirement of a low investment amount.

Alternatively, a track-restricting rod assembly comprises an arc regulator and a track-restricting rod. The arc regulator is fixed on the bottom seat. Arc slotted holes are set on the arc regulator. The track-restricting rod comprises a polished rod. A section of a screw mandrel is set on a first end of the polished rod, and a section of a screw mandrel is set on a second end of the polished rod. A sliding sleeve is sleeved on the polished rod. A diameter of the section of the polished rod is larger than the diameter of the section of the screw mandrel. A length of the section of the polished rod is smaller than a length of the sliding sleeve. A combination of a stop nut and a lock nut is set on the section of the screw mandrel that is set on the first end of the polished rod, and another combination of the stop nut and the lock nut is set on the section of the screw rod that is set on the second end of the polished rod. An anechoic spring is respectively sleeved on sections of the track-restricting rod that are between the sliding sleeve and the stop nuts which are set on both ends of the sliding sleeve. The sliding sleeve is hinged on the vibration box, wherein the section of the screw rod is hinged in the arc slotted holes.

A significant effect of a vibration exciter with a structure of the track-restricting rod assembly optimized is described as followed.

By adjusting a slip spacing of the track-restricting rod assembly, switching among a circular motion track, a linear motion track, and an elliptical motion track can be easily achieved in one device, which breaks a limitation that a vibration exciter only has one motion track. The three motion tracks are switched in one vibration exciter, for satisfying requirements of different working conditions to increase a functionality of the device, and expand an applicability of the device.

Alternatively, a track-restricting rod assembly comprises an arc regulator and a track-restricting rod. The arc regulator is fixed on the bottom seat. Arc slotted holes are set on the arc regulator. A sliding sleeve is sleeved on the track-restricting rod. A slip cavity is provided inside the sliding sleeve. A first opening end of the slip cavity is connected to an adjusted threaded sleeve that is coordinated by a thread, and a second opening end of the slip cavity is connected to an adjusted screw rod that is coordinated by the thread. A guide channel that is connected with the slip cavity is set inside the adjusted threaded sleeve. The track-restricting rod runs through the guide channel and stretches into the slip cavity. An upper lock nut is sleeved on an outside of the adjusted threaded sleeve. A lower lock nut is sleeved on an outside of the adjusted screw rod. An anechoic shock pad that is coordinated with the track-restricting rod is set in the slip cavity. An upper end of the track-restricting rod is hinged on the vibration box. A lower end of the adjusted screw rod is hinged on the bottom seat.

A function of the structural scheme equals to the function of the previous structural scheme, but what is more advantageous is that a length of the track-restricting rod can be adjusted. When a return function of a spring compression is changed in installing a device to debug, or because of a running hour, the length of the track-restricting rod can be adjusted precisely, for guaranteeing that the device is always in the best condition.

Alternatively, a track-restricting rod assembly and a vibrating spring are set on the same bottom seat. The track-restricting rod assembly comprises an arc guiding groove that is set on the bottom seat. An arc sliding board is set in the arc guiding groove. The arc sliding board is connected to a first end of a track-restricting rod. A second end of the track-restricting rod is connected to a vibration box by a supporting shaft. A first end of the vibrating spring is connected to the vibration box by the supporting shaft. A second end of the vibrating spring is fixed on a spring seat. The spring seat is fixed on the arc sliding board. By using a combination of the track-restricting rod and the spring in the track-restricting rod assembly, the vibration box is propped up to replace only use of a structure of the spring in a conventional technology, and the track-restricting rod not only makes a supporting function, but also changes a function of a motion track of a single-shaft vibration exciter of the conventional technology, in such a manner the spring possesses a function of a vibration excitation and a forcing keeping when the spring makes the vibration excitation.

Preferably, the vibrating spring is vertical to the track-restricting rod.

A unique characteristic of the structural scheme is that the track-restricting rod assembly and the vibrating spring are designed on the same bottom seat. Significant functional characteristics of the structural scheme are described as followed.

1. A load-bearing of the vibration box is shared by the track-restricting rod, and a burden of the load-bearing of the spring is decreased by the track-restricting rod, which are not possessed by various structural designs of track-restricting rods mentioned above in the conventional technology.

2. A spring is always in a vertical condition when loading and working, so a well vibrating function can be achieved and a service life of the spring can be prolonged.

In various structural designs of track-restricting rods mentioned above which comprise a conventional technical structure of a track-restricting rod, springs are all arranged in a vertical direction. Because an exciting force has a direction angle, a side of the spring is pressed. After the side of the spring is pressed for a long time, the spring is bent easily to deform, and a vibrating effect decreases gradually. The structural design eliminates the flaw mentioned above.

Alternatively, a track-restricting rod assembly comprises two arc regulators, two track-restricting rods, an upper connecting rod, and a lower connecting rod. The arc regulator is fixed on the bottom seat. Arc slotted holes are set on the arc regulator. Upper ends of the two track-restricting rods are both hinged on the upper connecting rod, and two articulated points are located on a vibration box. Lower ends of the two track-restricting rods are both connected to the lower connecting rod, and two articulated points are respectively located in the two arc slotted holes. The track-restricting rod is connected to a structure of a slip spacing.

Preferably, the structure of the slip spacing comprises a slip rod. A slip cavity is in the slip rod. A first end of the track-restricting rod stretches into the slip cavity. An anechoic rubber pad is set in the slip cavity. An external adjusted screw rod is set in an outside of the slip rod. The slip rod is fixed with the external adjusted screw rod by an upper lock nut. An internal adjusted screw rod is set in a second end of the external adjusted screw rod. An articulated end of the internal adjusted screw rod is hinged on the upper connecting rod, which is hinged in the arc slotted hole. The internal adjusted screw rod and the external adjusted screw rod are locked by a lower lock nut.

A characteristic of the structural design of the scheme is described as followed.

A parallelogram is formed by the two track-restricting rods, the upper connecting rod, and the lower connecting rod. An advantage is that when adjusting a vibrating direction angle, the two track-restricting rods are always in a paralleled condition for ensuring a good vibrating function.

Technical advancements of the present invention are described as followed.

1. A vibration box can be put horizontally to install and to use with a structure of a single-shaft vibration exciter, i.e., a circular motion track has a vibrating direction angle.

2. Various motion tracks can be switched in a same device.

3. The vibrating direction angle can be adjusted externally, visually, and simply.

Advantages of the present invention are described as followed.

1. A structural is simplified, and a manufacturing cost is decreased. Compared with a double-shaft structure and a triple-shaft structure, a single-shaft structure of the present invention saves two to three vibrating shafts, bearings, and gears which are expensive. The manufacturing cost of a track-restricting rod assembly of the present invention is ⅕ to ⅓ of the components above, i.e., 20% to 70% of the manufacturing cost can be saved.

2. A power loss is reduced, and a cost of running is low. A height of a vibrating shaft is large, and the vibrating shaft runs in a high speed, so the power loss of the vibrating shaft is large. The vibrating shaft is replaced by the track-restricting rod assembly of the present invention, so the power loss run can be saved by ¼ to ⅓.

3. The present invention can be easily installed, adjusted and maintained. A structure of a multi-shaft vibration exciter is complicated to be installed. Especially adjusting a direction angle thereof is hard. 3 to 5 people are needed to coordinated for accomplishing opening the track-restricting rod assembly, pulling out the gear, changing the direction angle, and installing the gear back. In contrast, one person can accomplish adjusting the direction angle quickly by using a structure of an arc slot of the present invention 4. A technology of the present invention can easily update old devices. Old devices can be retrofitted on site by using a vibrating screen or a feeding machine of the single-shaft vibration exciter of a conventional technology that matches with the track-restricting rod assembly.

5. A practicability and an applicability of the present invention are described as followed.

Groups of track-restricting rod assemblies of a single-shaft track-changeable vibration exciter can be designed to be a single group or to be multiple groups. The track-restricting rod assembly can be designed into various structures, for satisfying requirements of different motion tracks and requirements of different working conditions.

These and other objectives, features, and advantages of the present invention will become apparent from the following detailed description, the accompanying drawings, and the appended claims.

DETAILED DESCRIPTION OF THE PREFERRED EMBODIMENT

Figure 1:
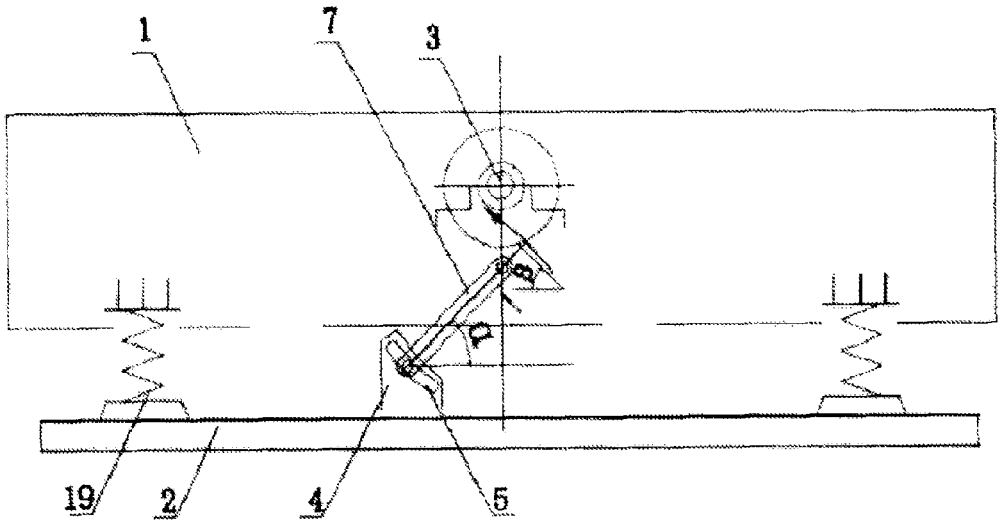
FIG. 1 is a front view of a single-shaft track-changeable vibration exciter according to a preferred embodiment of the present invention.

Referring to the drawings and preferred embodiments, technical schemes of the present invention are further described in detail as followed.

Preferred Embodiment 1

Figure 2:
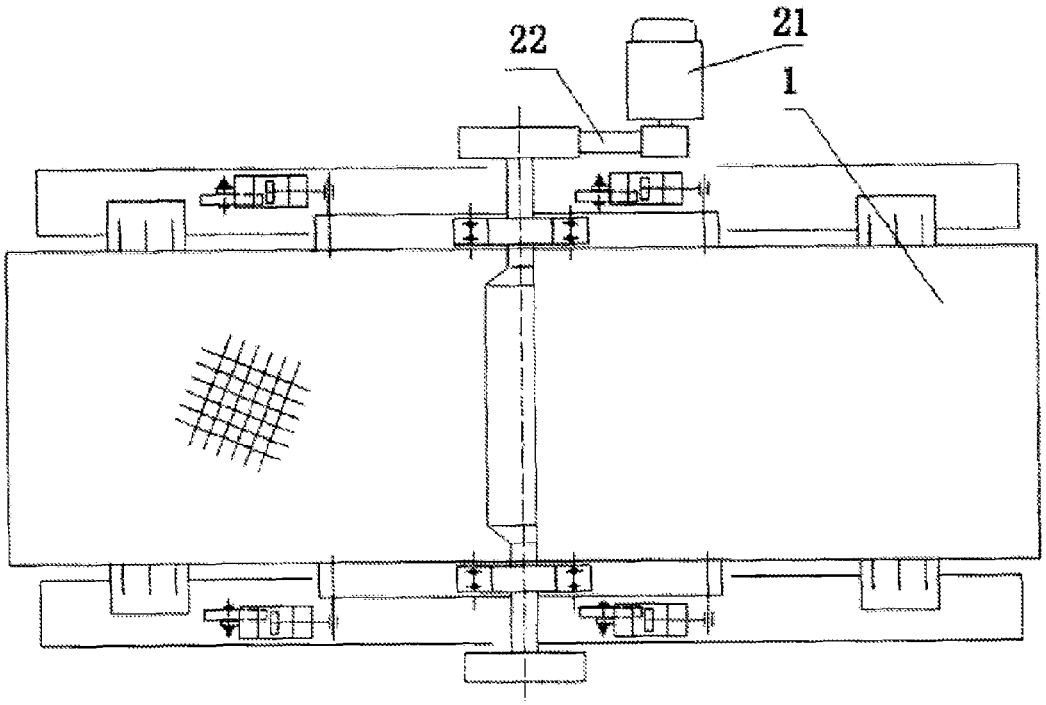
FIG. 2 is a top view of the FIG. 1 according to the preferred embodiment of the present invention.

Referring to FIG. 1 and FIG. 2 of the drawings, a single-shaft track-changeable vibration exciter comprises a vibration box 1, a bottom seat 2, and a vibrating shaft 3. The vibrating shaft 3 is set on the vibration box 1. Vibrating springs 19 are set between four squares that are between the vibration box 1 and the bottom seat 2. The vibrating shaft 3 is rotated by an electrical motor 21 through driving a belt 22. The vibrating shaft 3 is an eccentric shaft.

A track-restricting rod 7 that is arranged aslant is set between the vibration box 1 and the bottom seat 2. The track-restricting rod is in pairs and is arranged symmetrically on both sides of the vibration box 1. The track-restricting rod 7 is a fixed rod whose a length cannot be adjusted.

A lower end of the track-restricting rod 7 and an articulated shaft of the bottom seat 2 are set in an arc slotted hole 5, and is locked by an adjusted nut. The arc slotted hole 5 is set on a foundation support 4, and the foundation support 4 is set on the bottom seat 2. Because the lower end of the track-restricting rod 7 is locked by a nut, so when moving, the track-restricting rod is swung in a lower fixed point as a circle center.

The track-restricting rod 7 is set vertically to a fixed axial lead of the vibrating shaft 3, and an upper end of the track-restricting rod 7 and an articulated shaft of the vibration box 1 are set in a longitudinal line where the fixed axial lead of the vibrating shaft 3 is located. An angle is formed by the track-restricting rod 7 and a horizontal plane where the vibration box 1 is located in, which is an acute angle. The acute angle is $\alpha$, which is 60°. A vibrating direction angle is $\beta$. A relationship between $\beta$ and $\alpha$ is that $\beta=90°-\alpha$, and the angle of $\beta$ is 30°. Directing at different devices to adjust the vibrating direction angle $\beta$, the track-restricting rod 7 can be slid to be different angles in the arc slotted hole 5, and the track-restricting rod 7 is fixed by the adjusted nut.

Figure 14:
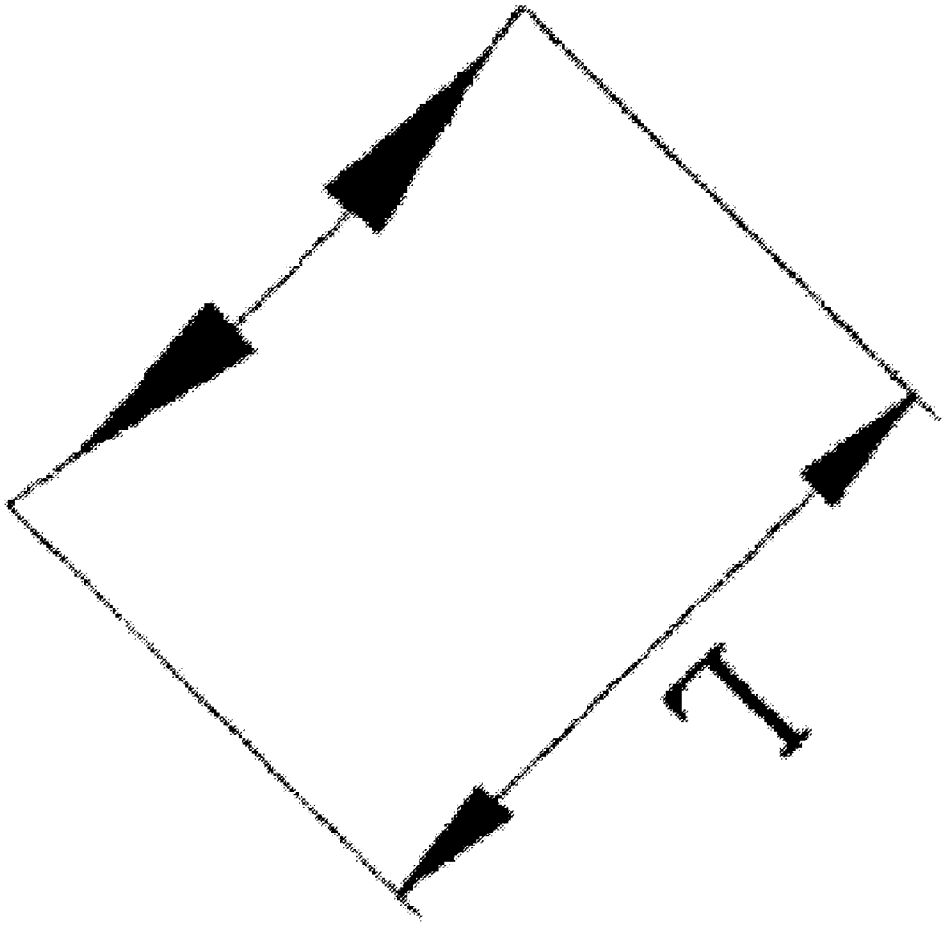
FIG. 14 is a schematic view of a linear motion track when m=0 according to the preferred embodiment of the present invention.

Because a length of the track-restricting rod 7 cannot be adjusted, so a slip spacing of the track-restricting rod 7 is m=0. Referring to FIG. 14, a motion direction of the vibrating spring 19 is shown by an arrow in the FIG. 1, which is a rocking arc motion. A motion track of materials that are in the vibration box 1 is a linear motion track.

Preferred Embodiment 2

Figure 3:
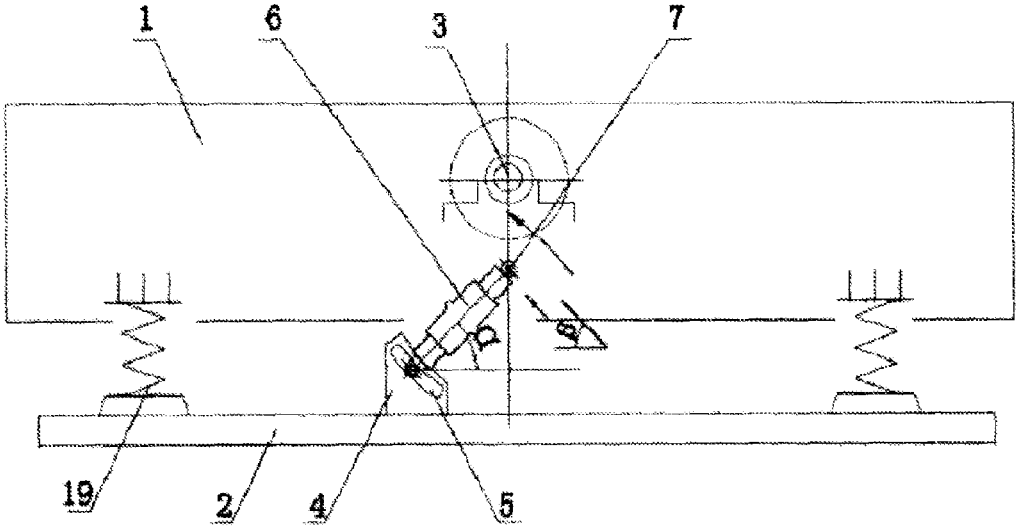
FIG. 3 is a first structural schematic view of the preferred embodiment of the present invention.
Figure 4:
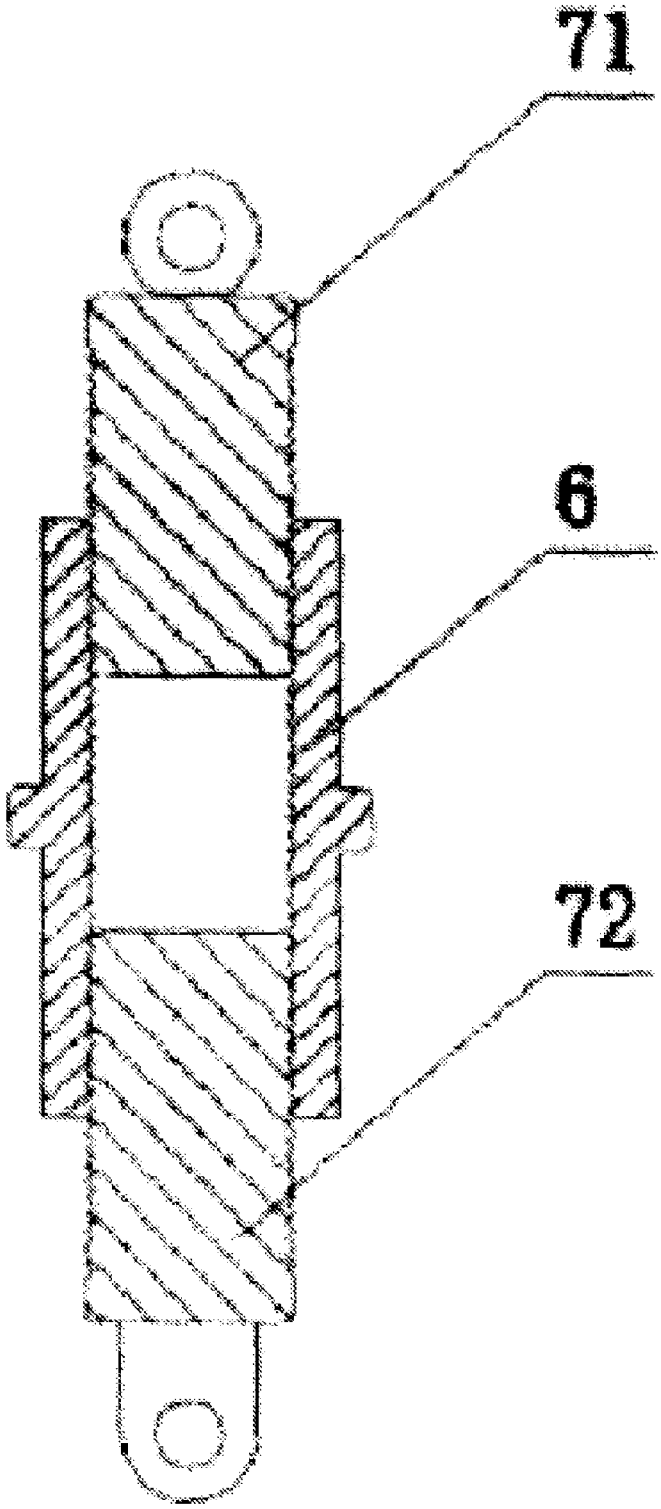
FIG. 4 is a structural schematic view of a track-restricting rod of the FIG. 3 according to the preferred embodiment of the present invention.

Referring to FIG. 3 and FIG. 4 of the drawings, a single-shaft track-changeable vibration exciter comprises a vibration box 1, a bottom seat 2, and a vibrating shaft 3. The vibrating shaft 3 is set on the vibration box 1. Vibrating springs 19 are set between four squares that are between the vibration box 1 and the bottom seat 2.

A track-restricting rod 7 that is arranged aslant is set between the vibration box 1 and the bottom seat 2. The track-restricting rod is in pairs and is arranged symmetrically on both sides of the vibration box 1.

The track-restricting rod 7 is formed by a screw rod whose two sections are separated and two direction of threads are opposite, which are an upper track-restricting rod 71 and a lower track-restricting rod 72. The upper track-restricting rod 71 is connected to the lower track-restricting rod 72 by a threaded sleeve 6. A free end of the upper track-restricting rod 71 is hinged on the vibration box 1. A free end of the lower track-restricting rod 72 is hinged on the bottom seat 2. Directing to different vibration boxes, a length of the track-restricting rod 7 can be adjusted by adjusting a length between the upper track-restricting rod 71 and the lower track-restricting rod 72. After adjusting the length of the track-restricting rod 7, the length of the track-restricting rod 7 is not changed when the track-restricting rod 7 is vibrated, so a slip spacing of the track-restricting rod 7 is m=0, and a motion track in the vibration box 1 is shown in FIG. 14.

A lower end of the lower track-restricting rod 72 and an articulated shaft of the bottom seat 2 are set in an arc slotted hole 5, and are locked by an adjusted nut. The arc slotted hole 5 is set on a foundation support 4, and the foundation support 4 is set on the bottom seat 2.

The track-restricting rod 7 is set vertically to a fixed axial lead of the vibrating shaft 3, and an upper end of the track-restricting rod 7 and an articulated shaft of the vibration box 1 are set in a longitudinal line where the fixed axial lead of the vibrating shaft 3 is located. An angle is formed by the track-restricting rod 7 and a horizontal plane where the vibration box 1 is located in, which is an acute angle. The acute angle is $\alpha$, which is 45°. A vibrating direction angle is $\beta$. A relationship between $\beta$ and $\alpha$ is that $\beta=90°-\alpha$, and the angle of $\beta$ is 45°.

Preferred Embodiment 3

Figure 5:
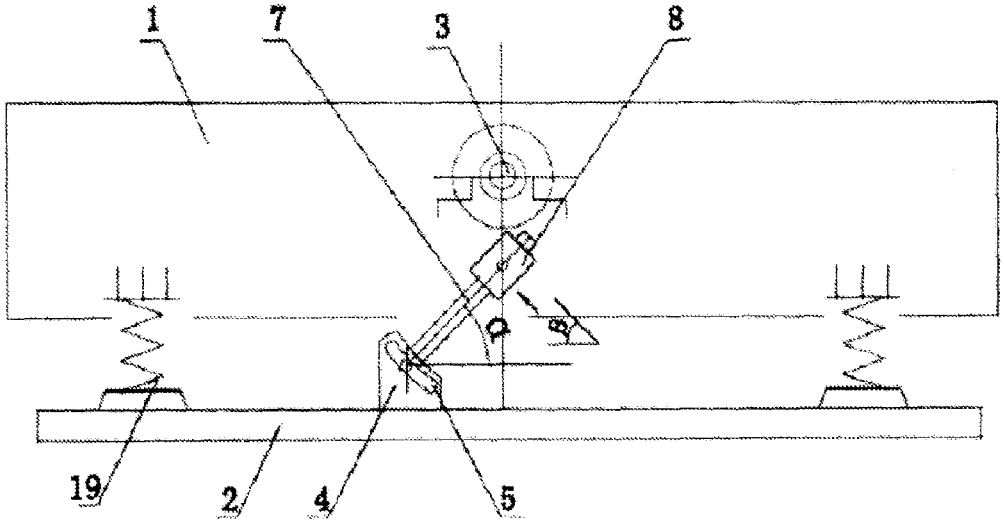
FIG. 5 is a second structural schematic view of the preferred embodiment of the present invention.
Figure 15:
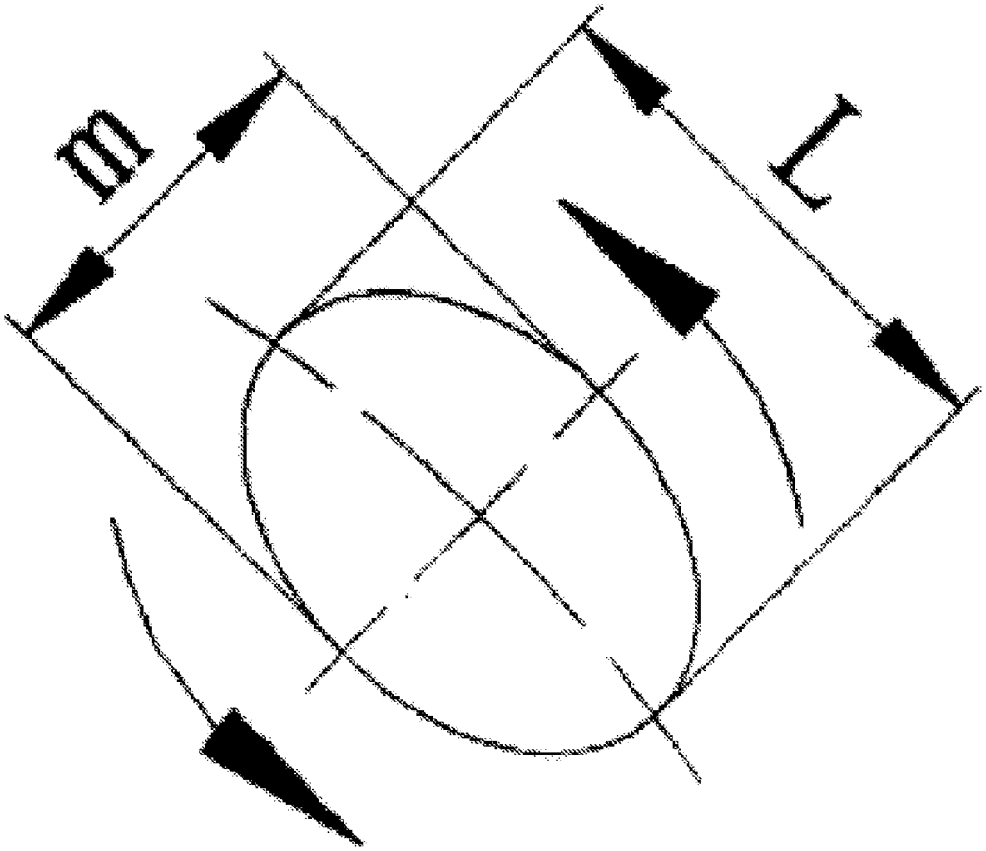
FIG. 15 is a schematic view of an elliptical motion track when m≠L according to the preferred embodiment of the present invention.
Figure 16:
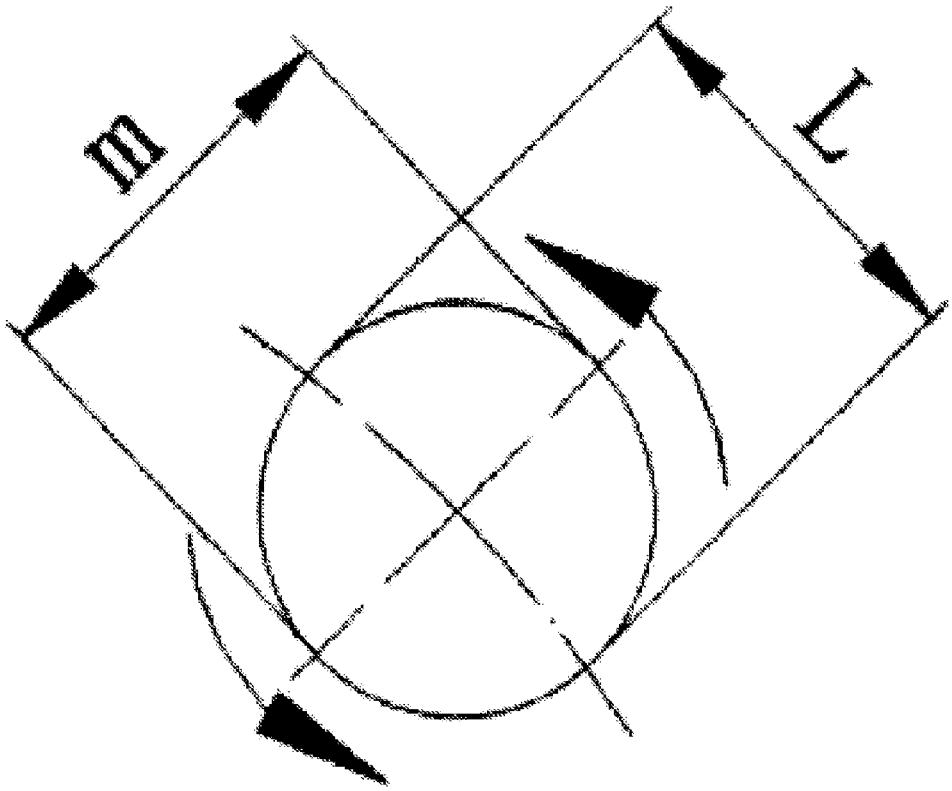
FIG. 16 is a schematic view of a circular motion track when m=L according to the preferred embodiment of the present invention.

Referring to FIG. 5 of the drawings, a single-shaft track-changeable vibration exciter comprises a vibration box 1, a bottom seat 2, and a vibrating shaft 3. The vibrating shaft 3 is set on the vibration box 1. Vibrating springs 19 are set between four squares that are between the vibration box 1 and the bottom seat 2. A track-restricting rod 7 is a straight rod. An upper end of the track-restricting rod 7 is set by a sleeve in a sliding sleeve 8, and the sliding sleeve 8 is hinged on the vibration box 1. A lower end of the track-restricting rod 7 is hinged on the bottom seat 2. The track-restricting rod 7 can be moved in the sliding sleeve 8, and a slip spacing m of the track-restricting rod 7 can be adjusted. Referring to FIG. 15, when m=L, a motion track is a circular motion track. Referring to FIG. 16, when m≠L, the motion track is an elliptical motion track. The track-restricting rod 7 is coordinated with the sliding sleeve 8 in sliding, so a length of the track-restricting rod 7 is not fixed. When installing the track-restricting rod 7 in a factory, any length requirements of the track-restricting rod 7 can be satisfied easily.

Remaining parts are same as the preferred embodiment 2.

Preferred Embodiment 4

Figure 6:
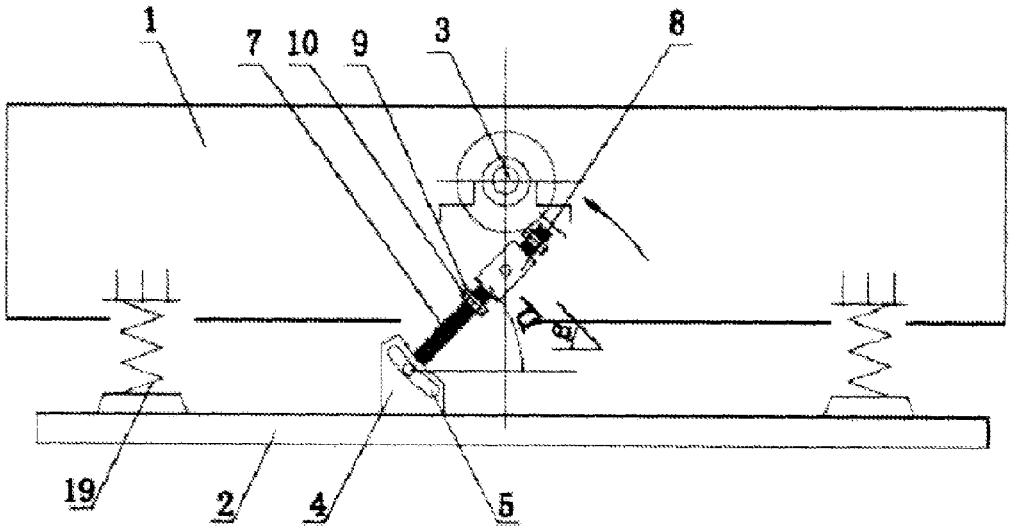
FIG. 6 is a third structural schematic view of the preferred embodiment of the present invention.
Figure 7:
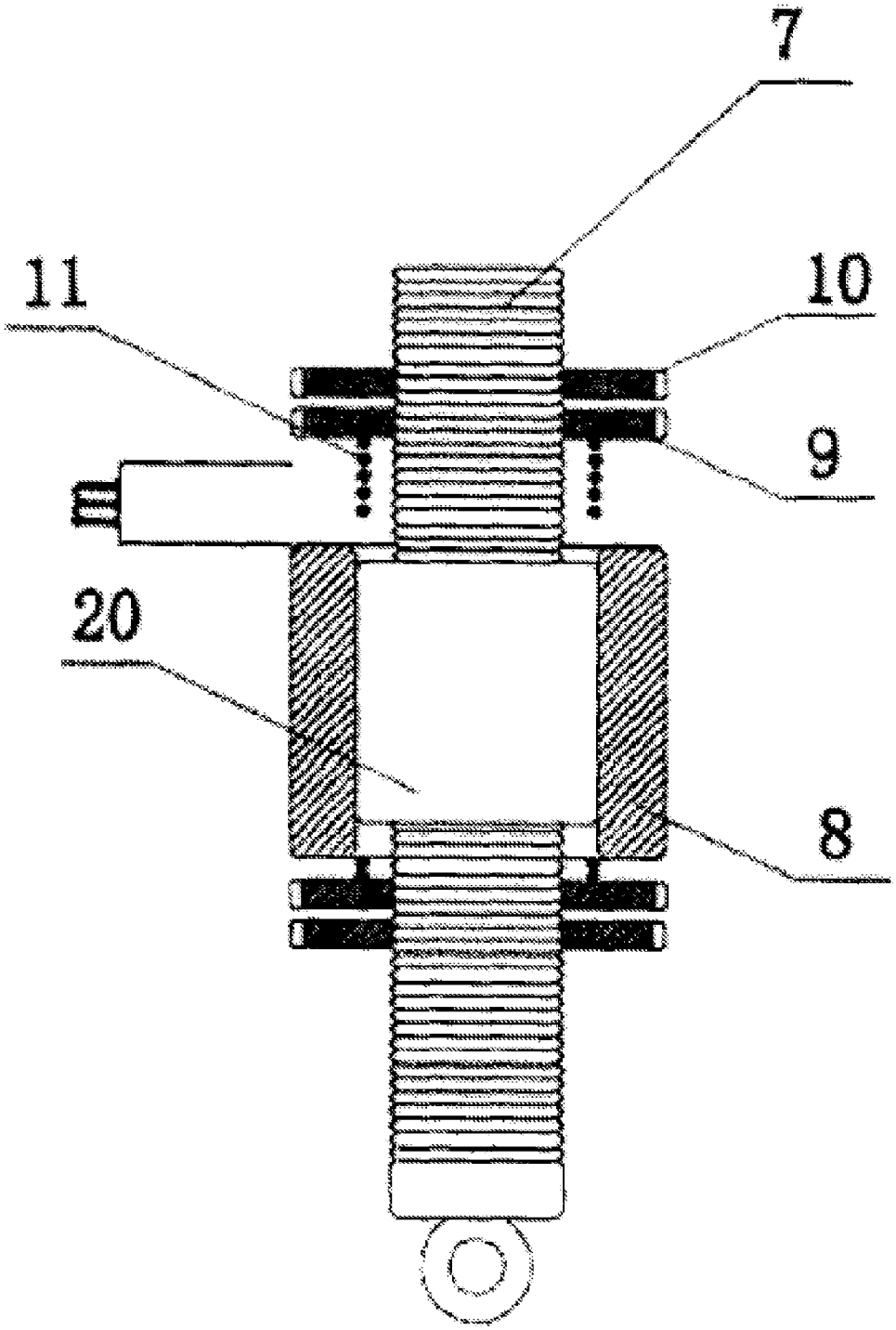
FIG. 7 is a structural schematic view of a track-restricting rod of the FIG. 6 according to the preferred embodiment of the present invention.

Referring to FIG. 6 and FIG. 7 of the drawings, a single-shaft track-changeable vibration exciter comprises a vibration box 1, a bottom seat 2, and a vibrating shaft 3. The vibrating shaft 3 is set on the vibration box 1. Vibrating springs 19 are set between four squares that are between the vibration box 1 and the bottom seat 2.

An upper end of a track-restricting rod 7 is sleeved on a sliding sleeve 8, and the sliding sleeve 8 is hinged on the vibration box 1. A lower end of the track-restricting rod 7 is hinged on the bottom seat 2.

A section of a polished rod 20 is set on the track-restricting rod 7. Both ends of the section of the polished rod 20 have sections of screw rods with external threads. A diameter of the section of the polished rod 20 is longer than a diameter of the section of the screw rod. A length of the section of the polished rod 20 is shorter than a length of the sliding sleeve 8. The section of the polished rod 20 is sleeved in the sliding sleeve 8. A combination of a stop nut 9 and a lock nut 10 is set respectively on the section of the screw rod of both ends of the section of the polished rod 20. An anechoic spring 11 is sleeved respectively on a section of the track-restricting rod 7 that is between the sliding sleeve 8 and the stop nut 9 which is in both sides of the sliding sleeve 8. When the track-restricting rod 7 is moving, the sliding sleeve 8 is fixed, and the track-restricting rod 7 moves in the sliding sleeve 8 to compress or to elongate the anechoic spring 11, a slip spacing m is formed. Referring to FIG. 15, when m=L, a motion track is a circular motion track. Referring to FIG. 16, when m≠L, the motion track is an elliptical motion track. The track-restricting rod 7 is coordinated with the sliding sleeve 8 in sliding, so a length of the track-restricting rod 7 is not fixed. When installing the track-restricting rod 7 in a factory, any length requirements of the track-restricting rod 7 can be satisfied easily.

Remaining parts are same as the preferred embodiment 3.

Preferred Embodiment 5

Figure 8:
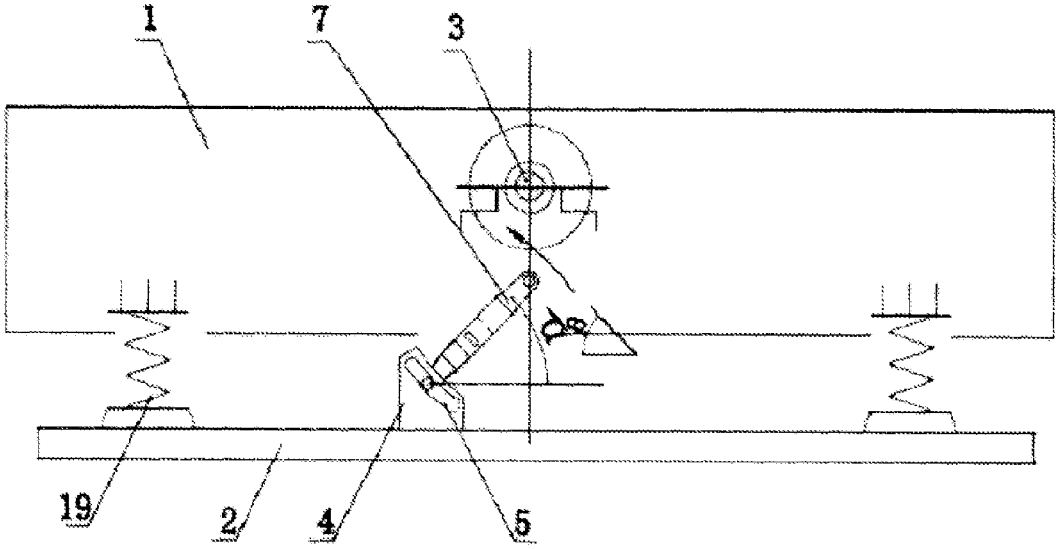
FIG. 8 is a fourth structural schematic view of the preferred embodiment of the present invention.
Figure 9:
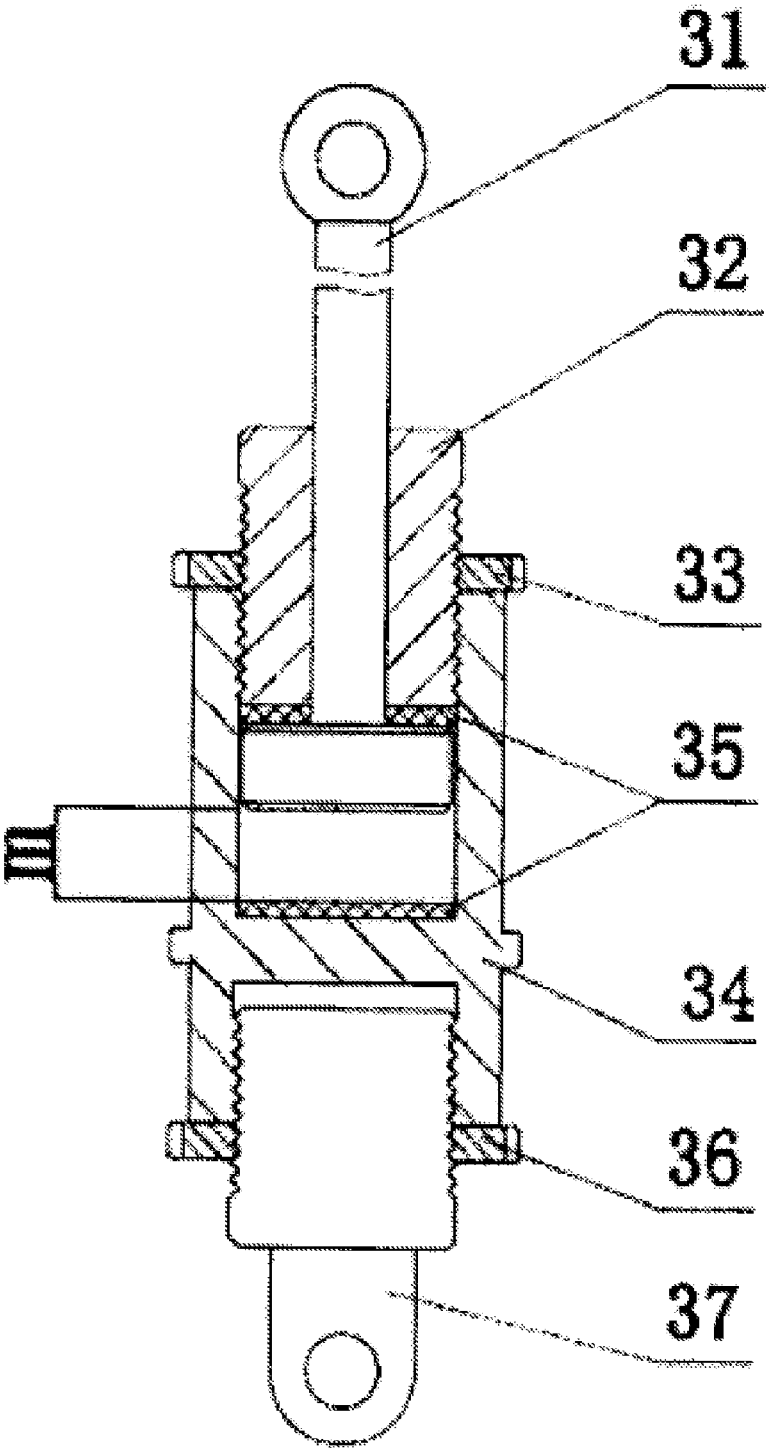
FIG. 9 is a structural schematic view of a track-restricting rod of the FIG. 8 according to the preferred embodiment of the present invention.

Referring to FIG. 8 and FIG. 9 of the drawings, a single-shaft track-changeable vibration exciter comprises a vibration box 1, a bottom seat 2, and a vibrating shaft 3. The vibrating shaft 3 is set on the vibration box 1. Vibrating springs 19 are set between four squares that are between the vibration box 1 and the bottom seat 2. A track-restricting rod assembly that is arranged aslant is set between the vibration box 1 and the bottom seat 2.

The track-restricting rod assembly comprises a track-restricting rod 7. A pair of a kinematic pair is constituted by the track-restricting rod 7 and a sliding guide rod 32, which can be slid elastically. The sliding guide rod 32 is sleeved into an external adjusted screw rod 34. A slip spacing m can be adjusted by an advance and a retreat of a thread. Referring to FIG. 15, when m=L, a motion track is a circular motion track. Referring to FIG. 16, when m≠L, the motion track is an elliptical motion track. The track-restricting rod 7 is coordinated with the sliding sleeve 8 in sliding, so a length of the track-restricting rod 7 is not fixed. When installing the track-restricting rod 7 in a factory, any length requirements of the track-restricting rod 7 can be satisfied easily. An internal adjusted screw rod 37 is connected to a lower thread of the external adjusted screw rod 34. A whole length of a telescopic rod 31 can be adjusted by screwing in and screwing out, for achieving to a best position in installing and adjusting. Before the whole length of the telescopic rod 31 is adjusted, an upper lock nut 33 and a lower lock nut 36 are needed to loose. After the whole length of the telescopic rod is adjusted, the upper lock nut 33 and the lower lock nut 36 are locked. An anechoic shock pad 35 provides a function of eliminating a hitting sound.

Remaining parts are same as the preferred embodiment 3.

Preferred Embodiment 6

Figure 10:
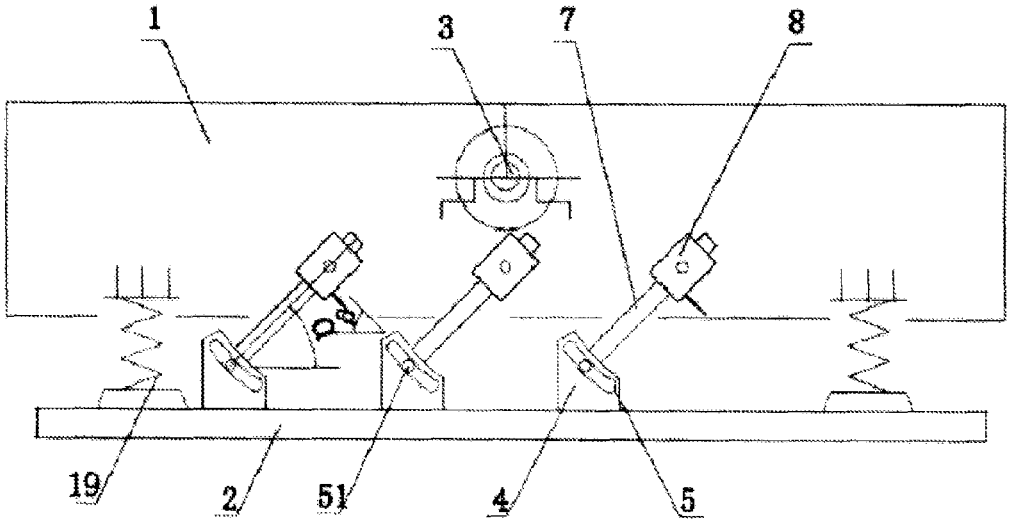
FIG. 10 is a fifth structural schematic view of the preferred embodiment of the present invention.

Referring to FIG. 10 of the drawings, a single-shaft track-changeable vibration exciter comprises a vibration box 1, a bottom seat 2, a vibrating spring 19, and a vibrating shaft 3. The vibrating shaft 3 is set on the vibration box 1. Vibrating springs 19 are set between four squares that are between the vibration box 1 and the bottom seat 2.

Three groups of track-restricting rod assemblies are set on the vibration box 1. Each group of the track-restricting rod assembly is arranged symmetrically on both sides of the vibration box 1. Referring to FIG. 3, the track-restricting rod assembly comprises a track-restricting rod 7 and a sliding sleeve 8. An upper end of the track-restricting rod 7 is sleeved in the sliding sleeve 8. The sliding sleeve 8 is hinged on the vibration box 1.

A lower end of the track-restricting rod is hinged on the bottom seat 2. A foundation support 4 is set on the bottom seat 2. An arc slotted hole 5 is set on the foundation support 4. The lower end of the track-restricting rod 7 and an articulated shaft of the bottom seat 2 are set in the arc slotted hole 5, and which are locked by an adjusted nut 51.

Track-restricting rods 7 are all arranged in a slant direction and in an array, and the track-restricting rods 7 are set vertically to a fixed axial lead of the vibrating shaft 3.

The sliding sleeve 8 of a track-restricting mechanism in a middle position of the track-restricting mechanisms which are in a same side of the vibration box 1 and an articulated shaft of the vibration box 1 are set in a longitudinal line where a fixed axis of the vibrating shaft 3 is located in. Other track-restricting rod 7 is arranged symmetrically in the longitudinal line where the fixed axis of the vibrating shaft 3 is located in.

An angle is formed by the track-restricting rod 7 and a horizontal plane. The angle is $\alpha$. An angle of $\alpha$ is 30°. A vibrating direction angle is $\beta$. A relationship among $\beta$, a telescopic rod, and $\alpha$ is that $\beta=90°-\alpha$. Remaining parts is same as the preferred embodiment 4. Of course, a structure of the track-restricting rod in the preferred embodiment 6 can be any one in the preferred embodiment 1 to 5 to form different motion tracks.

Preferred Embodiment 7

Figure 11:
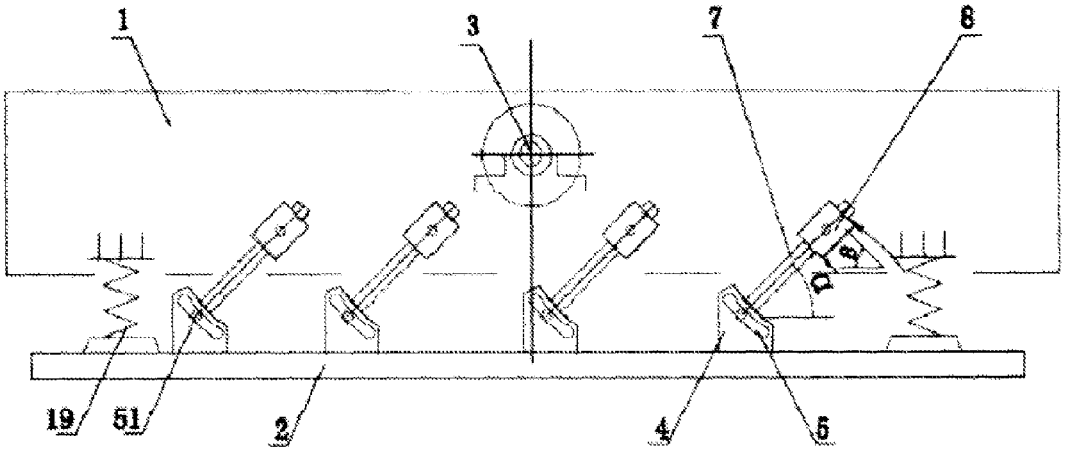
FIG. 11 is a sixth structural schematic view of the preferred embodiment of the present invention.

Referring to FIG. 11 of the drawings, in a single-shaft track-changeable vibration exciter, four groups of track-restricting rod assemblies are set on a vibration box 1, and each group of the track-restricting rod is arranged symmetrically in both sides of the vibration box 1. The track-restricting rod assembly comprises a track-restricting rod 7 and a sliding sleeve 8.

The track-restricting rod 7 that is in a same side of the vibration box 1 is arranged symmetrically by a center of a longitudinal line where a fixed axis of a vibrating shaft 3 is located in. Remaining parts are same as the preferred embodiment 6.

Preferred Embodiment 8

Figure 12:
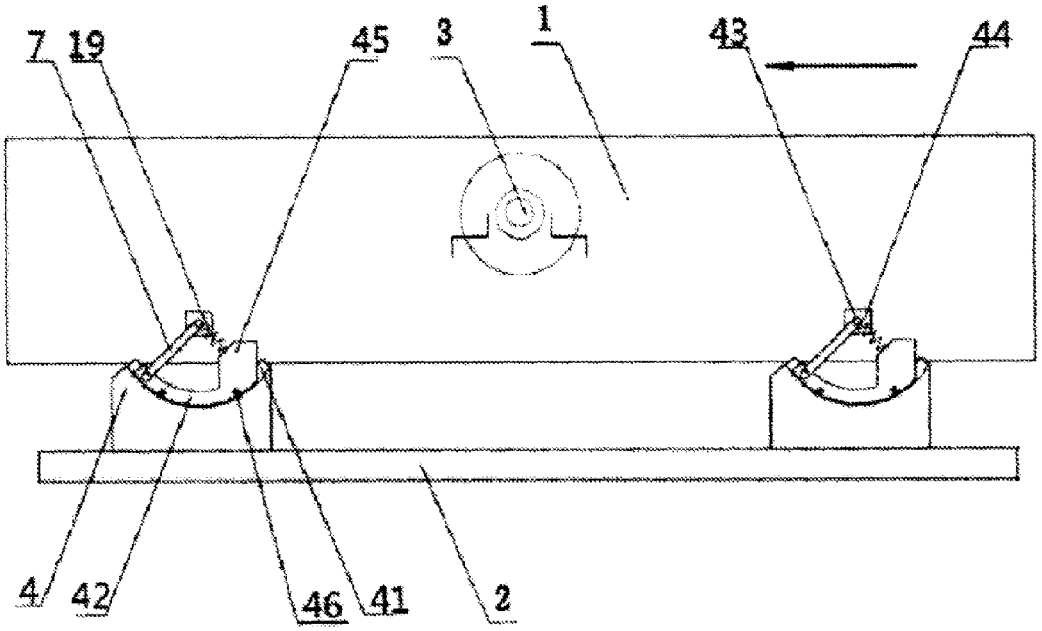
FIG. 12 is a seventh structural schematic view of the preferred embodiment of the present invention.

Referring to FIG. 12 of the drawings, a single-shaft track-changeable vibration exciter comprises a vibration box 1, a bottom seat 2, and a vibrating shaft 3. The vibrating shaft 3 is set on the vibration box 1. Vibrating springs 19 and a foundation support 4 that is integrated by the vibrating spring 19 are set respectively between four squares that are between the vibration box 1 and the bottom seat 2.

A track-restricting rod assembly comprises an arc guiding groove 41 that is set on the foundation support 4, an arc sliding board 42 that is set in the arc guiding groove 41, a track-restricting rod 7 that is connected to the arc sliding board 42, and a second end of the track-restricting rod that is connected to the vibration box 1 by a supporting shaft 43.

Each structures of a track-changeable mechanism are described as followed.

The supporting shaft 43 is fixed on a supporting seat 44 that is on the vibration box 1. The track-restricting rod 7 is arranged aslant between the vibration box 1 and the bottom seat 2. An upper end of the track-restricting rod is hinged vertically to the supporting shaft 43. A lower end of the track-restricting rod 7 is hinged on the arc sliding board 42. The track-restricting rod 7 is set vertically to a fixed axial lead of the vibrating shaft 3.

An upper end of the vibrating spring 19 is hinged vertically to the supporting shaft 43. A lower end of the vibrating spring 19 is fixed in the arc sliding board 42 by a spring seat 45. The track-restricting rod 7 and the vibrating spring 19 are arranged vertically.

The arc guiding groove 41 is set on the foundation support 4. The arc sliding board 42 is set in the arc guiding groove 41, and the arc sliding board 42 is locked by a lock nut 46.

A length of the track-restricting rod 7 cannot be adjusted. A slip spacing of the track-restricting rod 7 is m=0. A motion track of materials in the vibration box 1 is in a straight line.

Preferred Embodiment 9

Figure 13:
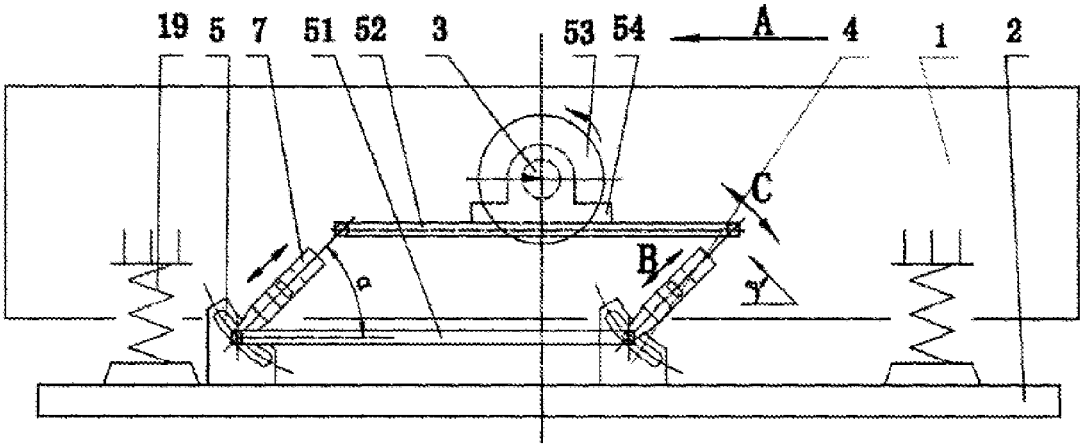
FIG. 13 is an eighth structural schematic view of the preferred embodiment of the present invention.

Referring to FIG. 9 and FIG. 13 of the drawings, a single-shaft track-changeable vibration exciter comprises a vibration box 1, a bottom seat 2, and a vibrating shaft 3. A belt wheel 53 is sleeved on the vibrating shaft 3. The vibrating shaft 3 is fixed on the vibration box 1 by a bearing seat 54. Vibrating springs 19 are set between fours squares that are between the vibration box 1 and the bottom seat 2.

The vibrating shaft 3 is rotated by an electrical motor 21 through driving a belt 22. The vibrating shaft 3 is an eccentric shaft.

A track-restricting rod assembly that is arranged aslant is set between the vibration box 1 and the bottom seat 2. The track-restricting rod assembly comprises arc regulators that are arranged symmetrically in both sides of the vibration box 1, a track-restricting rod 7, an upper connecting rod 52, and a lower connecting rod 51. Two arc regulators, two tract-restricting rods 7, two upper connecting rods 52, and two lower connecting rods 51 are set in each side of the track-restricting rod assembly. A four-bar linkage is constituted by the track-restricting rod 7, the upper connecting rod 52, and the lower connecting rod 51. The arc regulator comprises a foundation support 4. An arc slotted hole 5 is set on the foundation support 4. The foundation support 4 is fixed on the bottom seat 2. Upper ends of the two track-restricting rods 7 are both hinged on the upper connecting rod 52, and two upper articulated points are in the vibration box 1. Two lower ends of the two track-restricting rods 7 are both hinged on the lower connecting rod 51, and two lower articulated points are respectively located in two arc slotted holes 5.

Referring to FIG. 13, an A direction is a conveying direction of materials; a B direction is the direction of a slip linear motion of the track-restricting rod 7, i.e., the direction of a spacing of m can be adjusted; a C direction is the direction of a rocking arc motion, i.e., the direction of the spacing of L can be adjusted.

A length of the track-restricting rod 7 can be adjusted, and a mechanism of the track-restricting rod is shown in FIG. 9. A pair of a kinematic pair is constituted by the track-restricting rod 7 and a sliding guide rod 32, which can be slid elastically. The sliding guide rod 32 is set into an external adjusted screw rod 34. A slip spacing m can be adjusted by an advance and a retreat of a thread. Referring to FIG. 15, when m=L, a motion track is a circular motion track. Referring to FIG. 16, when m≠L, the motion track is an elliptical motion track. The track-restricting rod 7 is coordinated with the sliding sleeve 8 in sliding, so a length of the track-restricting rod 7 is not fixed. When installing the track-restricting rod 7 in a factory, any length requirements of the track-restricting rod 7 can be satisfied easily. An internal adjusted screw rod 37 is connected to a lower thread of the external adjusted screw rod 34. A whole length of a telescopic rod 31 can be adjusted by screwing in and screwing out, for achieving to a best position in installing and adjusting. Before the whole length of the telescopic rod 31 is adjusted, an upper lock nut 33 and a lower lock nut 36 are needed to loose. After the whole length of the telescopic rod is adjusted, the upper lock nut 33 and the lower lock nut 36 are locked. An anechoic shock pad 35 provides a function of eliminating a hitting sound.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A single-shaft track-changeable vibration exciter, comprising:

a vibration box, a bottom seat, a vibrating spring, and a vibrating shaft;

wherein said vibrating shaft is set on said vibration box, and said vibrating spring is set between said vibration box and said bottom seat; multiple track-restricting rod assembly groups that are arranged aslant are set in two sides of said vibration box; each of the track-restricting rod assembly groups comprises two track-restricting rod assemblies that are arranged symmetrically in both sides of said vibration box, and each end of each track-restricting rod assembly is hinged to both said vibration box and said bottom seat;

wherein said track-restricting rod assembly and said vibrating spring are set on said same bottom seat; said track-restricting rod assembly comprises an arc guiding groove that is set on said bottom seat; an arc sliding board is set in said arc guiding groove; said arc sliding board is connected to a first end of a track-restricting rod; a second end of said track-restricting rod is connected to said vibration box by a supporting shaft; a first end of said vibrating spring is connected to said vibration box by said supporting shaft; a second end of said vibrating spring is fixed on a spring seat; said spring seat is fixed on said arc sliding board.

2. The single-shaft track-changeable vibration exciter, as recited in claim 1, wherein said vibrating spring is vertical to said track-restricting rod.

* * * * *